US007028488B2

(12) United States Patent
Richard et al.

(10) Patent No.: US 7,028,488 B2
(45) Date of Patent: Apr. 18, 2006

(54) METHOD AND APPARATUS TO MINIMIZE FRACTIONATION OF FLUID BLEND DURING TRANSFER

(75) Inventors: Robert G. Richard, Hamburg, NY (US); Henk van der Maaten, Terheijden (NL)

(73) Assignee: Honeywell International Inc., Morristown, NJ (US)

( * ) Notice: Subject to any disclaimer, the term of this patent is extended or adjusted under 35 U.S.C. 154(b) by 192 days.

(21) Appl. No.: 10/617,845

(22) Filed: Jul. 11, 2003

(65) Prior Publication Data

US 2004/0031538 A1 Feb. 19, 2004

Related U.S. Application Data

(60) Provisional application No. 60/395,747, filed on Jul. 12, 2002.

(51) Int. Cl.

| | |
|---|---|
| ***F17C 11/00*** | (2006.01) |
| ***F17C 9/02*** | (2006.01) |
| ***B65B 1/04*** | (2006.01) |
| ***B67D 5/54*** | (2006.01) |
| ***F04F 1/00*** | (2006.01) |

(52) U.S. Cl. ..... 62/46.1; 62/50.1; 141/102; 137/211.5; 137/210

(58) Field of Classification Search ..... 62/45.1, 62/46.1, 50.1; 137/93, 210, 211, 211.5; 141/102
See application file for complete search history.

(56) References Cited

U.S. PATENT DOCUMENTS

| | | | | |
|---|---|---|---|---|
| 3,106,071 | A * | 10/1963 | Green et al. | 62/50.1 |
| 3,371,497 | A * | 3/1968 | Singleton | 62/46.1 |
| 3,656,657 | A | 4/1972 | Smith et al. | 222/4 |
| 4,031,912 | A * | 6/1977 | Lu et al. | 137/5 |
| 5,647,391 | A * | 7/1997 | Chan et al. | 137/93 |
| 5,921,263 | A * | 7/1999 | Negley, III | 137/3 |
| 5,964,094 | A * | 10/1999 | Butler et al. | 62/46.1 |
| 6,119,735 | A * | 9/2000 | Carter | 141/59 |
| 6,234,352 | B1 | 5/2001 | Richard et al. | 222/95 |
| 6,237,348 | B1 * | 5/2001 | Ide et al. | 62/50.1 |
| 2004/0134201 | A1 * | 7/2004 | Flohr et al. | 62/46.1 |
| 2004/0148945 | A1 * | 8/2004 | Matheoud | 62/48.2 |

* cited by examiner

*Primary Examiner*—William C. Doerrler
(74) *Attorney, Agent, or Firm*—Colleen D. Szuch

(57) ABSTRACT

A method of dispensing a liquid material from a source container which includes a blend of fluids of a first composition that normally fractionate upon boiling. A material of a second composition (different than that of the first composition) and capable of maintaining the first composition of the material remaining in the source container is added to the source container during the transfer of liquid from the source container. This addition of a material of a second composition to the supply container during the transfer can minimize and/or even eliminate fractionation of the liquid in the source tank.

19 Claims, 3 Drawing Sheets

METHOD AND APPARATUS TO MINIMIZE FRACTIONATION OF FLUID BLEND DURING TRANSFER

RELATED APPLICATIONS

This application claims the benefit if U.S. Provisional Application No. 60/395,747, filed Jul. 12, 2002, and which is hereby incorporated by reference herein.

FIELD OF THE INVENTION

The present invention relates to a method and apparatus for minimizing fractionation of fluid blends during dispensing, and more particularly to a method and apparatus for dispensing fluid blends while minimizing fractionation in the source container.

BACKGROUND OF THE INVENTION

High glide refrigerant blends such as HFC R407C, HCFC R409A and other zeotropic refrigerant blends (to a lesser extent HFC R410A and HFC R507) fractionate during transfers of the blends from one container (e.g., tank or cylinder) to another causing the composition of the blend to change. This change in composition can make the product off specification, change it's performance and/or make the material hazardous.

With the phase out of CFCs (implicated ozone depleting materials), the refrigeration and air condition industry has had to use substitute blends that are optimized based on many different properties. Ideally, replacement refrigerant compositions should have the same thermodynamic properties as the composition being replaced, as well as chemical stability, low toxicity, non-flammability and efficiency-in-use. Unfortunately, single component replacement refrigerants are often unable to provide all of the desired properties. In order to match the properties of the refrigerants being replaced, blends of environmentally acceptable refrigerants have been developed to achieve the best possible performance, capacity, efficiency and safety, as well as minimal cost. Blends of liquids, however, can fractionate.

A liquid heated above its boiling point changes phases to a vapor, and a vapor cooled below its condensation point changes phases to a liquid. For pure, single component fluids the boiling point and condensation point temperatures at a given pressure are the same, and the composition of such a fluid is the same in its vapor and liquid states. Fluids can also change state due to a change of pressure. When the pressure on a liquid is lowered below the vaporization pressure it becomes a vapor, and when the pressure is increased above its condensation pressure, it becomes a liquid. For a pure, single component fluid the vaporization and condensation point pressures at a given temperature are the same, and the composition of such a fluid remains constant.

For blends of fluids having different thermodynamic properties, however, such as refrigerant blends, the relationship between vaporization and condensation is more complex. In such fluid mixtures, boiling or condensation may occur over a range of temperatures rather than at a single fixed point. For example, for non-azeotropic blends (also referred to as zeotropic blends) as the temperature of such a fluid mixture in liquid state is raised, the lower boiling-point components boil off preferentially. The point at which the liquid first begins to vaporize is referred to as the bubble point, i.e. the point at which bubbles first form. The bubble point can be expressed as the temperature above which a constant pressure liquid begins to vaporize, or it can be expressed as the pressure below which a constant temperature liquid begins to vaporize, also referred to as the bubble point pressure. Conversely, for such a blend in vapor state, as the temperature of the vapor is lowered, the highest condensation temperature components begin to condense first. The point at which vapor first begins to condense is referred to as the dew point. The dew point can be expressed as the temperature below which a constant pressure vapor begins to vaporize, or it can be expressed as the pressure above which a constant temperature vapor begins to condense, also referred to as the dew point pressure. Thus, a fluid blend begins to vaporize at its bubble point, and completes the vaporization at its dew point, and vice versa. The range between the bubble and dew points is often referred to as the "glide."

Because of the different boiling points of the components of such blends, the fluids tend to segregate or fractionate during boiling. That is, as the temperature increases, the lower boiling point components vaporize preferentially. This results in the vapor having a higher concentration of the lower boiling components than the liquid, and a lower concentration of the higher boiling components. This effect is referred to as segregation or fractionation. As a result, when such a fluid blend is stored in a closed container in which there is a vapor space above a quantity of liquid, the composition of the vapor is different from that of the liquid. When such blends are withdrawn from the container in which they are stored, fractionation of the liquid remaining in the container can take place, with accompanying changes in composition of the remaining liquid. Composition changes of the mixture can be quite significant, and even relatively small composition changes cannot be tolerated in certain circumstances. Such changes can cause a refrigerant to have a composition outside of specified limits, to have different performance properties or even to become hazardous, such as by becoming flammable.

The problem of fractionation is a particular problem for high-glide refrigerants because of the greater tendency of the low and high boiling point components to segregate. On the other hand, pure single component fluids have zero glide. The composition of the initial vapor is the same as that of the final vapor as the liquid boils off. Therefore, they do not experience the compositional changes of high-glide fluid blends during vaporization.

It is a standard practice to make up blends in large tanks which then are used to fill cylinders for sale and use. As discussed above, in transferring from the bulk or source tank, the composition of the liquid remaining in the source tank can change. The vapor above the liquefied blend has a different composition then the liquid. This can lead to a change in composition as the liquid is removed from the container such that it the remaining liquid occupies a different volume. This shift in composition is undesirable since it can lead to changes in performance, efficiency and safety of the blend.

ASHRAE (American Society of Heating, Refrigeration and Air Conditioning Engineers) and ARI (Air-Conditioning and Refrigeration Institute) have recognized these problems and have examined the effect of the shift in composition. A recognized problem is that in normal transfers this fractionation can change the refrigerant blend composition sufficiently such that the blend will no longer be within the tolerances originally set. A means of transferring that can avoid this undesirable effect is needed.

One means of dealing with this problem has been to use one-use packages. Here, a cylinder contains the exact quantity of material needed for a given application, the liquid material stored within being completely used in that one use. This is not practical in the air conditioning and refrigeration industry due to the wide variety of equipment and charge sizes required. The number of different size package would be too large to stock and manage economically.

Another known means to prevent fractionation is to have only a single phase present in the cylinder of refrigerant. Using only liquid in the cylinder is not practical due to temperature changes and during use the liquid filled condition is not maintained. If only vapor is used, the tank contains much less material or must be very large. Therefore, this approach is rarely practical.

A common method has been to remove only liquid from the container. This is not ideal. This causes far less fractionation then removing vapor but the composition still does shift and in some situation by more than can be tolerated in the refrigeration and air-conditioning industry. An improvement on this idea was to mix some vapor with the liquid as it was removed, using a perforated dip tube as described in U.S. Pat. No. 3,656,657. This method has not been widely used, probably due to the flow rate dependency.

The use of a bladder has been used in packages in the past and has the potential to solve this problem. The concept is used to prevent fractionation of the refrigerant blend during dispensing by preventing a vapor space from forming, see e.g., U.S. Pat. No. 6,234,352.

Accordingly, it is an object of the invention to provide a method and apparatus the permits dispensing of a refrigerant blend with minimal fractionation.

Other objects and advantages of the invention will become apparent from the following description of the invention.

SUMMARY OF THE INVENTION

A novel method of dispensing a liquid material so as to minimize fractionation is disclosed. The liquid material includes a blend of fluids of a first composition that normally fractionate upon boiling. For carrying out the method, a source container which has the liquid to be dispensed is provided. The source container holds a liquid phase and a vapor phase. A receiving container into which liquid from the source container will be transferred or dispensed may also be provided. A portion of the liquid material in the source container is transferred out, e.g., to the receiving container, leaving a remainder of liquid material in the source container. A second material having a second composition different from that of the first composition and which, upon addition to the source container, will maintain the composition of the remainder of material in the source container at substantially the same composition as the first composition is transferred to the source container. This transfer of a material of a second composition can be done simultaneously with the transfer of fluid from the source container to the receiving container, or at different times. Moreover, the second material can be of the same composition as a vapor initially over the liquid in the source container, or include only those components necessary to replace those that are depleted from the liquid in the source container due to the transfer. This method is particularly useful with high glide refrigerants. An apparatus for carrying out the invention is also provided.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE INVENTION

The present invention discloses a method for minimizing fractionation (change in composition) of a blend of liquids during transfers. For purposes of illustrating the invention, blends of high glide refrigerants to be transferred from one container to another will be discussed below. It is understood, however, that the present invention is not limited to refrigerants, but is applicable to any blend of liquids that may fractionate upon boiling.

Figure 1:
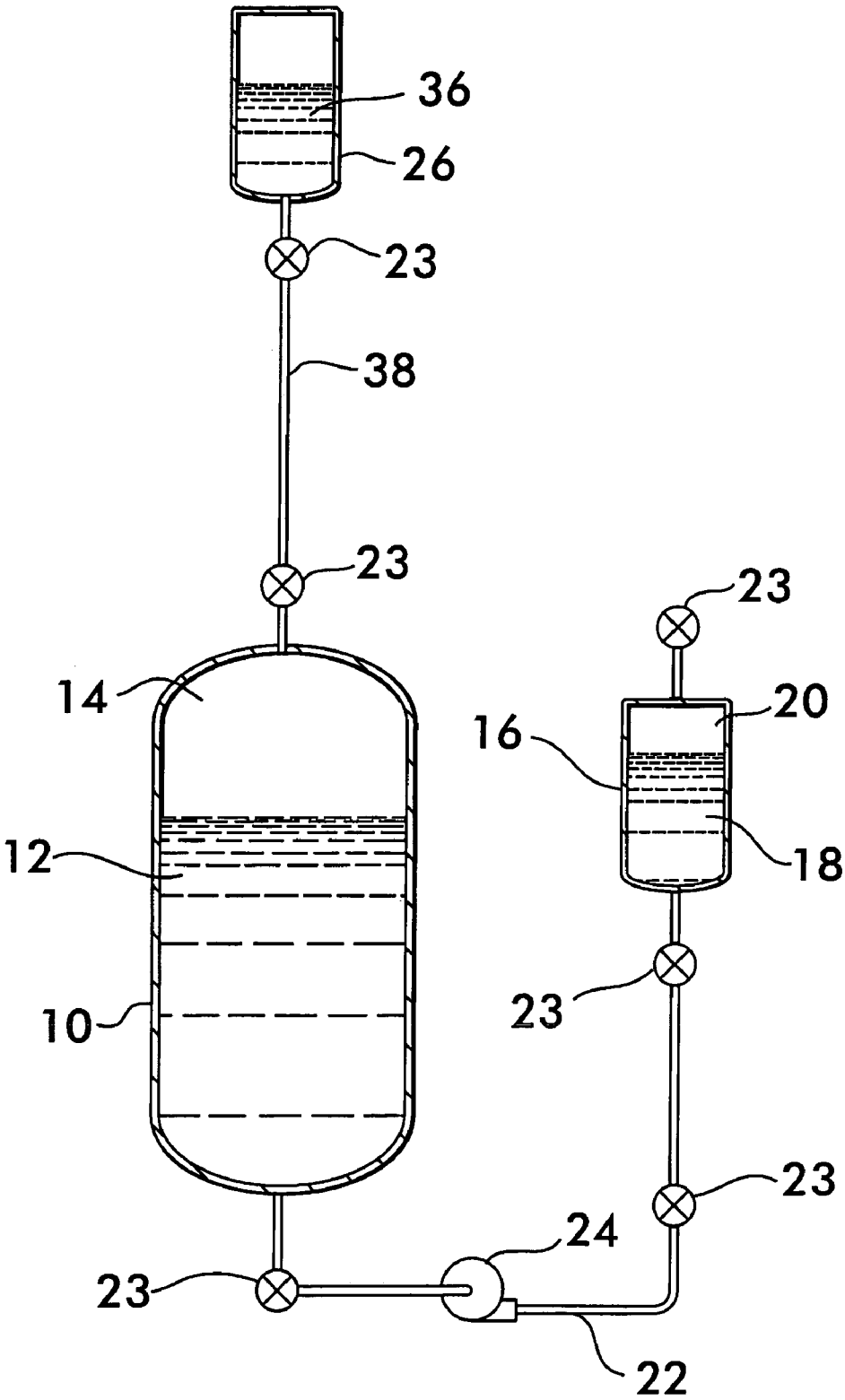
FIG. 1 is an schematic diagram illustrating a method of the present invention.

With reference to FIG. 1, a source container 10 (e.g., a tank or cylinder) contains a multi-component material in liquid form 12, i.e., a blend of fluids of a particular composition. For example, this blend of fluids could be R407C which is a blend of three refrigerants having the following composition by weight: R32—23±2%, R125—25±2%, and R134a—53±2%. The source container 10 is a closed container capable of holding both the liquid 12 and a vapor 14, and is preferably sufficiently large to hold a suitable amount of liquid 12 for filling multiple smaller receiving containers.

A receiving container 16 (e.g., a tank or cylinder), generally of smaller volume capacity than the source container 10 is to be filled with liquid 12 from the source tank 10. It, likewise, is a closed container capable of holding both a liquid 18 and a vapor 20. A fluid conduit 22 and pump 24 is used to transfer the liquid 12 from the source container 10 to the receiving container 16, with suitable valves 23 to control the fluid flow and close off the respective containers, as is known in the art. Liquid phase 12 transfers are used for filling the receiving containers 16 to maximize volume utilization and pumping speed, and minimize the composition shift during transfers. Once filled, the receiving container 16 is disconnected from the conduit 22 for use, and a new receiving container 16 can be connected to the conduit 22 to be filled with liquid 12 from the source container 10.

As a volume of the liquid 12 is removed from the source container 10, it leaves a void (the volume removed) that must be filled. Normally, this void is filled by vaporization of the liquid 12 remaining within the container 10. For reasons discussed above, in general, this vapor 14 has a different composition then the liquid 12, which means that the composition of both the liquid and vapor phases remaining in the source container 10 change, leading to a composition shift of the liquid 12 as the source container 10 is used. Moreover, with each successive filling, the composition shift becomes greater and greater. The present invention corrects this problem.

In accordance wit the present invention, a material having a composition different than that of the liquid 12 in the source container 10 is added to the source container 10 to maintain the composition of the refrigerant blend, so that no or at least minimal fractionation occurs. This method is useful in the packaging of refrigerant blends, especially those with high glides.

To prevent or minimize this composition shift, a specific amount of material, here refrigerant, at a composition different from that of the liquid 12 in the source container 10 is added to the source container 10. This material has a specific composition and mass that has been pre-determined to be capable of maintaining the composition of the liquid remaining in the source container 10 at substantially the same composition as the initial liquid 12 being transferred after a filling/transfer procedure. This material corrects for the imbalance to the composition caused by the liquid 12 vaporizing, filling the void formed when the liquid is transferred out of the source container 10. Thus as the liquid 12 in the source container 10 is transferred out to fill receiving containers 16, the composition of the remaining liquid 12 in the source container 10 remains substantially the same, i.e., within the desired specification for that liquid.

As an example, R407C is a blend of refrigerants R32, R125, and R134a. Where a source container 10 containing R407 is used to fill a receiving container 16, as the liquid material 12 is transferred out, the lower boiling point components R32 and R125 would vaporize to fill the void at a higher rate than the higher boiling point R134a. By adding a specific amount of material of a specific composition of R32 and R125, which is a different composition than that of the R407C, the original composition of the R407C can be substantially maintained. This added material, having a "second composition", has been predetermined to maintain the composition of the liquid in the source container 10.

There are various means of carrying out the present invention which are now described in further detail. In a first means, the vapor needed to fill the void in the source tank 10 and which has been predetermined to be capable of maintaining the desired composition of the liquid 12 therein is added to the source container 10. A simple example of this is described with further reference to FIG. 2.

Figure 2:
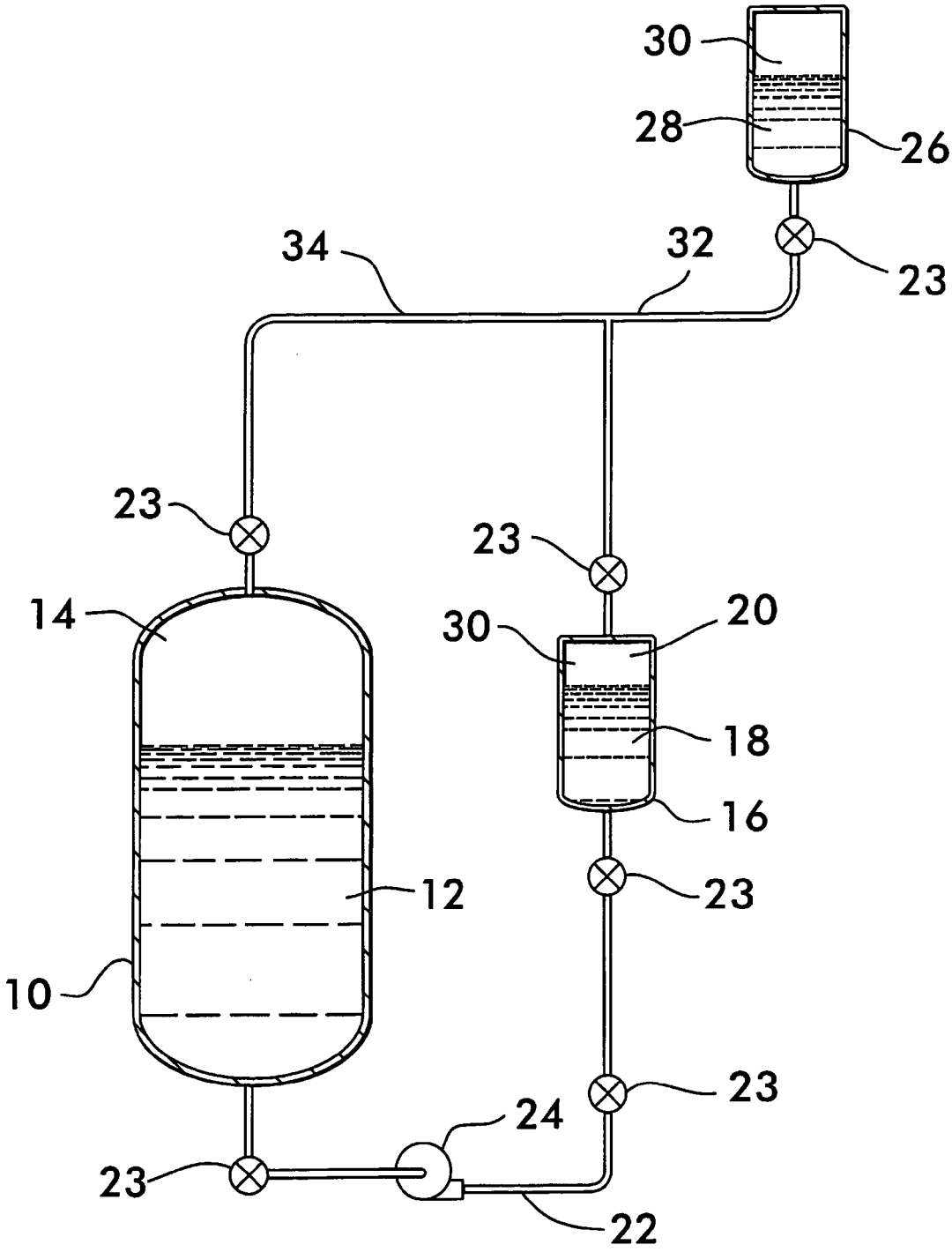
FIG. 2 is a schematic view of an apparatus for carrying out the present invention.

FIG. 2 is similar to that of FIG. 1 with the same elements identified with the same reference numbers. Here, prior to the transfer of liquid 12 from the source container 10 to the receiving container 16, the receiving container 16 is pre-filled with a vapor 30. Prior to any filling operation, the source container 10 contains the liquid 12 at a first composition and a vapor 14 in equilibrium at a second composition. The vapor 30 is of the same composition as that of the vapor 14 at the second composition. The source of this vapor 30 can be a supply container 26 as shown, which can hold the vapor 30 at the desired composition, a vapor 30 over a liquid of the same composition, or a liquefied gas 28 which has the same composition as the vapor 14 in the source container 10. In the last case, the liquid phase 28 would be flashed into the receiving container 16 to provide the desired pre-filling of the evacuated receiving container 16 with the vapor 30.

Thus the receiving container 16 to be filled is evacuated and pre-filled with vapor 30 from the supply container 26 through fluid transfer conduit 32. Preferably, the amount of vapor 30 added to the receiving container 16 should be sufficient to match the pressure in the source tank 10, or to bring the pressure in the receiving container 16 to the saturation pressure of the vapor 30. This will substantially equalize the pressures in the source and receiving containers. The supply container 26 is then isolated from the receiving container 16, e.g., the fluid transfer conduit 32 is disconnected from the receiving container 16 or valved off.

For the filling operation, two transfer lines are used, the fluid conduit 22 for transferring the liquid 12, and fluid conduit 34 for transferring the vapor 30. As the liquid 12 is transferred (e.g., pumped) from the container 10 to the receiving container 16, the vapor displaced by the transferred liquid in the receiving container 16 is transferred to the source container 10 through the fluid conduit 34. The vapor transferred from the receiving container 16 to the source container 10 prevents flashing of the liquid 12 remaining in the source container 10 and, because the vapor 30 is at the same composition as the vapor 14 already above the liquid 12, maintains the composition of the liquid 12.

The fluid conduit 34 connected to the fluid conduit 32 also allows the vapor 30 in the source container 10 to be evacuated when all the liquid 12 has been emptied from the source container 10. This could be done by way of a compressor that evacuates the vapor in the source container 10 which can be condensed and transferred back to the supply container 26.

As an alternative to pre-filling the receiving container 16, the vapor 30 can be added directly to the source container 10 from the supply container 26 without linking the vapor spaces of the source container 10 and the receiving container 16. Here, the receiving container 16 need not be pre-filled with vapor. As the liquid 12 is transferred from the source container 10 to the receiving container 16, vapor 30 is added directly from the supply container 26 to the source container 10. To ensure that the correct amount of vapor 30 is added to the receiving container 10, one possibility is to add a pre-determined mass of vapor 30 for each unit of mass of liquid 12 transferred from the source container 10 to the receiving container 16. It is appreciated that with this alternative, the vapor 30 can be added at the same time as the liquid is being transferred out to the receiving container 16, or added after one or more fill (transfer) operations is completed. Where only small amounts of liquid are transferred in any fill operation, the change in composition of the liquid during the fill operation is minimal and the addition of vapor 30 after a fill operation should be sufficient to keep the liquid 12 in the source container 10 within specification. As another alternative, the addition of vapor 30 can be made at preplanned increments, e.g., after the transfer of 25% of the original mass of liquid 12 in the source container 10, and then after 75% is transferred. The means of determining the amount of vapor 30 to be added is discussed in further detail below.

Another means of carrying out the present invention is now discussed with reference to FIG. 1. This method does not require pre-filling of the evacuated receiving container 16, but requires the determination of the amount of a material 36 of the second composition to be added to the source container 10 to maintain the desired first composition of the remaining liquid 12. In this embodiment, it is accepted that there may be some vaporization of the liquid 12 in the source container 10 as liquid 12 is transferred to the receiving container 16. Here, the material 36 added is only that which is needed to replace those fluid components in the source container 10 which may be depleted from the liquid due to this vaporization. The composition of the material 36 to be added and the amount per unit of liquid 12 dispensed can be pre-determined as discussed in more detail below. This addition of material 36 can be made as the liquid 12 is being transferred out, or alternatively, at intervals such as after each or some of the transfers, or at predetermined intervals. The composition of the material only shifts in the source container 10 to a small extent and then is corrected by the material being added to maintain the original composition. This correction can be sized to over correct a small amount such that as further material is removed from the source container 10 the composition shift brings the composition of the liquid 12 back to nominal.

The supply container 26 contains the material 36 for replacing the depleted components and can be fluidly connected to the source container 10 by a transfer line 38. As the liquid 12 is being transferred from the source container 10, the void that would normally be created is filled with the material supplied from the supply container 26. It is appreciated that if liquid from the supply container 26 is added to the source container in this embodiment, some of the liquid may not vaporize but may stay in liquid form, replacing some of the liquid material in the source container 10 that may have vaporized during the fluid transfer process to the container 16.

The various embodiments of the present invention can be expressed mathematically as will now be discussed. In accordance with the invention, a void left by the liquid 12 transferred is replaced with material that maintains the initial composition of the vapor in equilibrium with the liquid. This maintains the composition as described by the following equations.

The size of the void volume is given by the sum of the volume of liquid 12 removed to the receiving container 16 plus that of the liquid 12 remaining in the source container that flashes:

$$\frac{mR}{dl} + \frac{mf}{dl} = Vvoid$$

where mR=mass remove or transfer out of the tank mf=mass of material flashed (note: this material was not added)

dl=liquid density

Vvoid: volume of void left from liquid removed

The mass of vapor needed to fill this void is the void volume times the vapor density:

$$Vvoid\ dv = mv$$

where dv=vapor density mv=mass of vapor

The mass of each component "i" of the vapor needed to fill the void is the product of its vapor composition times the mass of vapor (giving an equation for each component: i equations):

$$y_i * mv = m_i$$

where:

$y_i$=vapor composition: mass fraction in vapor of ith component

The mass of each component "i" of the vapor to be added is the mass added plus the mass flashed (giving an equation for each component of the vapor to be added: there being i number of equations):

$$m_i = ma * xa_i + x_i * mf$$

Where:

$m_j$=mass in the vapor of ith component $x_i$=mass fraction in liquid of ith component $xa_i$=mass fraction added, ith component ma=mass of material added Conditions for the above equations:

Case 1: Total vapor replacement i.e., all of the components of the vapor 14 originally above the liquid 12 are added to fill the void as illustrated in the embodiment of FIG. 2:

mf=0

Case 2: Only the more volatile materials are replaced as illustrated in the embodiment using FIG. 1 (the depleted components in the source container 10):

xa=0 i is the lease volatile component.

Various examples are now discussed to further illustrate the invention.

EXAMPLE 1

The first example provides R407C in the source container 10 and assumes that the total vapor in the source container 10 is replaced. All the material of a second composition is added to fill the void left from the liquid 12 being transferred out of the container 10. This is equivalent to having mf (mass of not added material flashed) set to zero. Thus the material added to the source container 10 will be of the same composition of the vapor 14 above the initial liquid 12. This is so whether done by the method shown in FIG. 2 (prefilling and transfer of the vapor 30 from the receiving container 16 to the source container 10 during filling) or adding vapor 30 of the same composition as the vapor 14 initially above the liquid from a direct source 26.

The solution is:

mf=0

$$mR * \frac{dv}{dl} = mv$$

and $$y_i * mv = xa_i * ma$$

Refrigerant R407C is a fluid blend having a composition as follows:

| | |
|---|---|
| R32 | 23 wt % |
| R125 | 25 wt % |
| R134a | 52 wt % |

The mass of a material blend having a second composition to be added to the source container 10 is as follows:

the mass to be added: mR*dv/dl=100*(48.82 kg/m$^3$)/(1138 kg/m$^3$)=ma=4.29 lb of the following composition for every 100 lb of liquid 12 transferred out of source container 10

| | |
|---|---|
| R32 | 32.59 wt % |
| R125 | 31.47 wt % |
| R134a | 35.94 wt % |

The density of the liquid and vapor of R407C at 25° C. are 1138 and 48.82 kg/m$^3$ respectively. The vapor composition 14 is the same as the composition of the vapor 30 of the second composition to be added to the source chamber 10. Properties of the vapor 14 and liquid 12 can be obtained by analysis of the contains of 10 or from PVT, VLE correlation database like NIST database 23 REFPROP.

For the embodiment of FIG. 2, the supply container 16 is pre-filled with this vapor 30 which is automatically transferred to the source container 10 by displacement as the liquid 12 is transferred.

EXAMPLE 2

In this example, only the depleted components (from the liquid) due to vaporization of the remaining liquid 12 in the container 10 are replaced. Therefore, the least volatile component concentration is set to zero.

$$\frac{mR+mf}{dl}=Vvoid$$

$$Vvoid*dv=mv$$

$$y_i*mv=m_i$$

$$m_i=ma*xa_i+x_i*mf$$

As this is a case 2 condition:

$xa_i=0$ Lease volatile component.

Using R407C as an example, which liquid has the following blend:

| | |
|---|---|
| R32 | 23 wt % |
| R125 | 25 wt % |
| R134a | 52 wt % |

This requires that 1.36 lbs of the below listed blend per 100 lbs of liquid 12 removed be added to the source container 10:

| blend to be added | |
|---|---|
| R32 | 54.04 wt % |
| R125 | 45.96 wt % |

Using refprop 6.01 for the pure and blend refrigerant properties.

The calculations for the above results are illustrated below:

$$\frac{mR+mf}{dl}=Vvoid$$

$$Vvoid*dv=mv$$

$$y_{R32}*mv=_{R32}$$

$$y_{R125}*mv=m_{R125}$$

$$y_{R134a}*mv=m_{R134a}$$

$$m_{R32}=ma*xa_{R32}+x_{R32}*mf$$

$$m_{R125}=ma*xa_{R125}+x_{R125}*mf$$

$$m_{R134a}=0$$

$$mR=100\text{ kg}$$

Knowing the liquid and vapor properties of the material in the source container 10, the following results can be determined (as mention above these can be obtained by analysis or database like REFPROP):

| Liquid phase (R407C in the source container 10) | |
|---|---|
| $x_{R32}$ | 23 wt % |
| $x_{R125}$ | 25 wt % |
| $x_{R134a}$ | 52 wt % |
| dl | 1138 kg/m$^3$ |

| Vapor phase (above the liquid phase in the source container 10) | |
|---|---|
| $y_{R32}$ | 32.59 wt % |
| $y_{R125}$ | 31.47 wt % |
| yR134a | 35.94 wt % |
| dv | 48.82 kg/m$^3$ |

This gives nine equations with nine unknowns (mf, Vvoid, mv, $m_{R32}$, $m_{R125}$, $mR_{134a}$, ma, $xa_{R32}$, $xa_{R125}$, $xa_{Rl34a}$). These can be solved to give:

| | |
|---|---|
| $xa_{R32}$ | 54.04 wt % |
| $xa_{R125}$ | 45.96 wt % |
| $xa_{R134a}$ | 0.00 wt % |
| mf | 3.056 kg |
| $V_{void}$ | 0.09058 m$^3$ |
| mv | 4.422 kg |
| ma | 1.365 kg |
| $m_{R32}$ | 1.441 kg |
| $m_{R125}$ | 1.392 kg |
| $m_{R134a}$ | 1.589 Kg |

EXAMPLE 3

In this example, similar to that illustrated above with reference to FIG. 1, a source container 10 is filled with R407C until 85% liquid full. The refrigerant blend is then transferred out to receiving containers 16 with no addition of a correcting material of a second composition. The liquid 12 remaining in the container 10 is monitored, the results shown in Table A below. This is compared to a liquid transferred from a container 10 where a correcting material 36 having a second composition (blend) of 54/45 percentage by weight of R32/R125 is added at a rate of 0.0136 lb/lb of liquid 12 removed as calculated in the example 2 above. The results are shown in Table B. The liquid 12 in the container 10 with the addition of material 36 did not change in composition while the liquid 12 in the container 10 using the normal transfer method (no addition of correcting material) changed. When starting with an 85% filled tank of 23/25/52 wt % of R32/R125/R134a respectively, and then transferring liquid without addition of a correcting material of a second composition, this gave a final-liquid composition in the remaining liquid 12 of 21.69/24.05/54.26 wt % of R32/

R125/R134a as shown in Table A. The addition of a 54/45 wt % blend prevented a shift in composition as shown in Table B.

TABLE A

| | R32 | R125 | R134a |
|---|---|---|---|
| 0 | 22.9 | 25.0 | 52.1 |
| 10 | 22.9 | 24.9 | 52.2 |
| 30 | 22.8 | 24.8 | 52.4 |
| 50 | 22.6 | 24.7 | 52.6 |
| 70 | 22.4 | 24.6 | 53.0 |
| 90 | 22.0 | 24.3 | 53.8 |
| 94 | 21.8 | 24.1 | 54.1 |
| 95 | 21.7 | 24.0 | 54.3 |

(R407C liquid transferred at 70° F. with no additions of a material to prevent fractionation. The left column indicates the total percentage of mass by weight of the liquid 12 transferred out as compared to the initial amount of liquid in the container 10. The numbers in the columns under the listing of the individual refrigerants are percentages of that component by weight.)

TABLE B

| | R32 | R125 | R134a |
|---|---|---|---|
| 0 | 22.9 | 25.0 | 52.1 |
| 10 | 22.9 | 25.0 | 52.1 |
| 30 | 22.9 | 25.0 | 52.1 |
| 50 | 22.9 | 25.0 | 52.1 |
| 70 | 22.9 | 25.0 | 52.1 |
| 90 | 22.9 | 25.0 | 52.1 |
| 94 | 22.9 | 25.0 | 52.1 |
| 95 | 22.9 | 25.0 | 52.1 |

(R407C with the addition of a material to prevent or minimize fractionation (R32/R125 54.04/45.96 wt %) at a rate of 1.46 lb/100 lb removed at 77° F. (25° C.) The left column indicates the total percentage of mass by weight of the liquid 12 transferred out as compared to the initial amount of liquid in the container 10. The numbers in the columns under the listing of the individual refrigerants are percentages of that component by weight.)

EXAMPLE 4

The addition of material of a second composition to the source container 10 for correcting the composition of the liquid 12 therein can be done in stages rather than continuously. For example, in one possibility, only after one half of the liquid 12 in the container 10 has been transferred is material of the second composition added. The remainder of the liquid 12 in the source container 10 is transferred thereafter. Additional stages can be added until the additional material is continuously added i.e., material of the second composition is added with or after each transfer.

For this particular example, two additions of material of a second composition are made, one when twenty-five percent of the liquid 12 initially in the source container 10 has been transferred, and a second one when seventy-five percent of the liquid 12 has been transferred. Further, the added material is not the ideal blend calculated above in example 3 for maintaining the original composition, but is AZ20 (a composition of 50% R32 and 50% R125). Nevertheless, this maintained good stability in the composition of the liquid 12 remaining in the container 10 as shown below.

R407C remaining in a source container 10 adjusted using AZ20 (the material of the second composition for correction) after 25% and 75% of the initial amount of liquid in the source container 10 is transferred to a receiving container 16, at 25° C., provided the results listed below in Table C. The left column indicates the total percentage of mass by weight of the liquid 12 transferred out, as compared to the initial amount of liquid in the container 10. The numbers in the columns under the listing of the individual refrigerants are percentages of that component by weight.

TABLE C

| | R32 | R125 | R134a |
|---|---|---|---|
| 0 | 22.9 | 25.0 | 52.1 |
| 10 | 22.9 | 24.9 | 52.2 |
| 15 | 22.9 | 24.9 | 52.2 |
| 20 | 22.8 | 24.9 | 52.3 |
| 25 | 22.8 | 24.9 | 52.3 |
| 25 | 23.1 | 25.1 | 51.8 |
| 33 | 23.0 | 25.1 | 51.9 |
| 40 | 23.0 | 25.0 | 52.0 |
| 48 | 22.9 | 25.0 | 52.1 |
| 55 | 22.8 | 25.0 | 52.2 |
| 63 | 22.8 | 24.9 | 52.3 |
| 70 | 22.7 | 24.8 | 52.5 |
| 75 | 22.6 | 24.8 | 52.6 |
| 75 | 23.3 | 25.5 | 51.2 |
| 80 | 23.2 | 25.4 | 51.4 |
| 85 | 23.1 | 25.3 | 51.6 |
| 90 | 22.9 | 25.2 | 51.9 |
| 93 | 22.8 | 25.1 | 52.1 |

Figure 3:
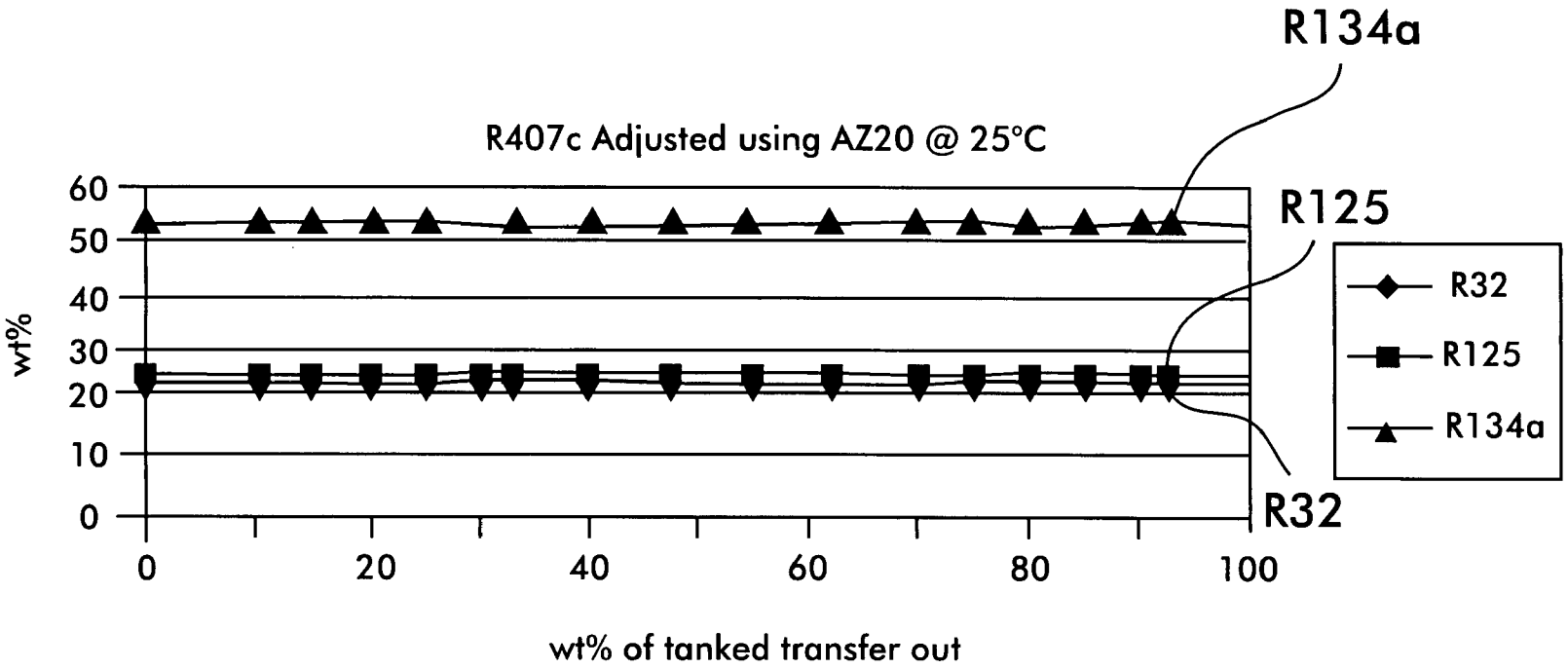
FIG. 3 is a graph of the results from one of the examples of the invention herein.

A graph of these results is provided in FIG. 3.

Thus, it is seen that the present invention can maintain the composition of the liquid 12 remaining in a source container 10 at substantially the same composition, i.e., within the desired blend ranges or specification, by adding a second material that can correct for the changes that would normally occur.

Changes and modifications in the embodiments described herein can be carried out without departing from the scope of the invention which is intended to be limited only by the scope of the appended claims.

What is claimed is:

1. A method of dispensing a liquid first material comprising a first composition of multiple components that normally fractionate upon boiling, said method comprising:

(a) providing a source container containing said liquid first material to be dispensed, said source container containing a vapor phase in contact with said liquid first material;

(b) providing a receiving container;

(c) transferring a portion of the liquid material in said source container to said receiving container and leaving a remainder of liquid material in said source container;

(d) providing a second material to be added to said source container, said second material having a second composition of components chosen from said multiple components and which second composition is different from that of said first composition and comprises at least one of said multiple components, said second composition and the mass of said second material to be added to said source container for a given mass of liquid material transferred in step (c) being predetermined to maintain the composition of said remainder of liquid material in said source container substantially the same as said first composition, and wherein the predetermined mass of said second material to be added is less than said given mass of liquid material transferred, and said predetermining step comprising calculating said mass of said second material to be added for said given mass of liquid material transferred, said calculating step accounting for the differences between the compositions of the liquid and the vapor phases of said first material; and (e) transferring to said source container said predetermined amount of said second material.

2. A method of dispensing in accordance with claim 1 wherein said second material added to said source container is a vapor.

3. A method of dispensing in accordance with claim 1 wherein said second material is a liquid which is flashed at least partially to a vapor.

4. A method of dispensing in accordance with claim 1 wherein step (c) and step (e) are carried out simultaneously.

5. A method of dispensing in accordance with claim 1 wherein step (c) and step (e) are carried out at different times.

6. A method of dispensing in accordance with claim 1 wherein step (e) is carried out by transferring a vapor to said source container, said vapor having a composition substantially the same as that of said vapor phase in said source container.

7. A method of dispensing in accordance with claim 6 wherein said transferred vapor of step (e) comes from said receiving container.

8. A method of dispensing in accordance with claim 6 wherein said transferred vapor of step (e) comes from a supply container.

9. A method of dispensing in accordance with claim 1 wherein prior to step (c), pre-filling said receiving container with a vapor having a composition similar to that of a vapor above the liquid in said source container; and after step(c), carrying out step (e) by transferring the vapor in said receiving container to said source container.

10. A method of dispensing in accordance with claim 1 wherein said second material has at least one less component than said first material.

11. A method of dispensing in accordance with claim 1 wherein step (c) and step (e) are carried out simultaneously at times, and out at different times at other times.

12. A method of dispensing in accordance with claim 1 wherein said second material contains only those components that are depleted from the liquid remaining in the source container during step (c).

13. A method of dispensing a liquid first material comprising a composition of multiple components that normally fractionate upon boiling, the method comprising:

(a) providing a closed source container which includes said liquid to be dispensed, said source container holding a vapor phase in contact with said liquid material;

(b) transferring a portion of the liquid material in said source container out of said source container and leaving a remainder of liquid material in said source container; and (c) transferring into said source container a second material having a second composition different from that of said first composition and which comprises at least one of said multiple components, the second composition and the mass of said second material to be added to said source container for a given mass of liquid material transferred out in step (b) being calculated to maintain the composition of said remainder of liquid material in said source container at substantially the same composition as said first composition and wherein the calculated mass of said second material to be added is less than said given mass of liquid material transferred, and said calculating step accounting for the differences between the compositions of the liquid and vapor phases of said first material.

14. A method of dispensing in accordance with claim 13 wherein said second material added to said source container is a vapor.

15. A method of dispensing in accordance with claim 13 wherein said second material is a liquid which is flashed to a vapor.

16. A method of dispensing in accordance with claim 13 wherein step (b) and step (c) are carried out simultaneously.

17. A method of dispensing in accordance with claim 13 wherein step (c) is carried out after a predetermined amount of liquid is has been transferred.

18. A method of dispensing in accordance with claim 13 wherein step (c) is carried out after step (b).

19. A method of dispensing in accordance with claim 13 wherein step (c) is carried out by transferring said portion to a closed receiving container.

* * * * *